US012798825B2

(12) United States Patent
Koretz et al.

(10) Patent No.: US 12,798,825 B2
(45) Date of Patent: Nov. 17, 2026

(54) DISPENSER FOR EYE SHIELDS

(71) Applicant: Medline Industries, LP, Northfield, IL (US)

(72) Inventors: Hailey Koretz, Chicago, IL (US); Anne-Clarisse Magtaan, Evanston, IL (US); Alessia Woods, Chicago, IL (US); Jacob Kurian, Chicago, IL (US)

(73) Assignee: Medline Industries, LP, Northfield, IL (US)

( * ) Notice: Subject to any disclaimer, the term of this patent is extended or adjusted under 35 U.S.C. 154(b) by 99 days.

(21) Appl. No.: 18/501,157

(22) Filed: Nov. 3, 2023

(65) Prior Publication Data

US 2025/0002210 A1 Jan. 2, 2025

Related U.S. Application Data

(63) Continuation-in-part of application No. 29/896,314, filed on Jun. 30, 2023, and a continuation-in-part of (Continued)

(51) Int. Cl.
*B65D 5/72* (2006.01)
*B65D 5/18* (2006.01)
(Continued)

(52) U.S. Cl.
CPC ..... *B65D 5/725* (2013.01); *B65D 5/18* (2013.01); *B65D 5/4204* (2013.01); *B65D 5/548* (2013.01); *B65D 85/54* (2013.01); *B65D 85/62* (2013.01)

(58) Field of Classification Search
CPC ..... B65D 5/725; B65D 5/18; B65D 5/4204; B65D 5/548; B65D 85/54; B65D 85/62
(Continued)

(56) References Cited

U.S. PATENT DOCUMENTS 1,378,534 A 5/1921 Fitz
1,412,547 A 4/1922 Weymuth
(Continued)

FOREIGN PATENT DOCUMENTS

CA 160309 3/2016
EP 15102981 6/2025
(Continued)

OTHER PUBLICATIONS

Best Medical & Research Supply (BMR Supply) Dispenser, for 13×100mm Glass Culture Tubes, Metal, https://www.bmrsupply.com/Dispenser-for-13x100mm-Glass-Culture-Tubes-Metal_p_3775.html, Oct. 1, 2014 (Year: 2014).
(Continued)

*Primary Examiner* — Rakesh Kumar
(74) *Attorney, Agent, or Firm* — Fitch, Even, Tabin & Flannery LLP

(57) ABSTRACT

A dispenser includes a body having a U-shaped cross-section, the body formed by folding a plurality of panels together along a plurality of fold lines. The dispenser includes an interior defined by the plurality of panels as folded, the interior of the body configured to hold a plurality of eye shields in a stacked configuration. A first access panel disposed at least partially within a front panel of the plurality of panels is configured to be removed to grant access to the interior of the body. The front panel is contiguous with only a single other one of the plurality of panels along a hinge line of the plurality of fold lines, and the front panel is configured to hingedly move via the hinge line to expose the interior of the body to enable access for loading the plurality of eye shields.

18 Claims, 11 Drawing Sheets

Related U.S. Application Data application No. 29/896,319, filed on Jun. 30, 2023, now Pat. No. Des. 1,116,819.

(51) Int. Cl.

| | |
|---|---|
| ***B65D 5/42*** | (2006.01) |
| ***B65D 5/54*** | (2006.01) |
| ***B65D 85/00*** | (2006.01) |
| ***B65D 85/62*** | (2006.01) |

(58) Field of Classification Search

USPC ..... 221/1

See application file for complete search history.

(56) References Cited

U.S. PATENT DOCUMENTS

| | | | | |
|---|---|---|---|---|
| 1,664,736 | A | 4/1928 | Creamer | |
| 1,898,056 | A | 2/1933 | Johnson | |
| 1,898,646 | A * | 2/1933 | Taylor | B65D 5/4225 229/120.24 |
| 1,959,231 | A * | 5/1934 | Dube | A24F 27/10 206/124 |
| 2,299,027 | A | 10/1942 | Novak | |
| 2,717,094 | A * | 9/1955 | George | B65D 25/22 220/360 |
| 3,040,881 | A * | 6/1962 | McNeill | A47F 7/021 206/5 |
| 3,186,591 | A | 6/1965 | Solomon | |
| 3,265,283 | A | 8/1966 | Farquhar | |
| 3,351,208 | A * | 11/1967 | Siegel | A47F 7/021 248/902 |
| 3,450,308 | A | 6/1969 | Schoenefeld | |
| 3,704,823 | A | 12/1972 | Howe | |
| 3,782,602 | A * | 1/1974 | Page | B65D 21/0219 222/509 |
| 3,836,007 | A * | 9/1974 | Rosenwein | A47F 7/021 116/75 |
| 3,858,726 | A * | 1/1975 | Rosenwein | A47F 7/021 206/5 |
| 3,891,092 | A * | 6/1975 | Surrette | A47F 7/021 211/163 |
| 3,924,750 | A * | 12/1975 | Dunchock | A47F 7/021 248/902 |
| 4,150,752 | A * | 4/1979 | Breining | A47F 7/021 211/2 |
| 4,211,331 | A * | 7/1980 | Salmon | A47F 5/02 211/163 |
| 4,269,315 | A | 5/1981 | Boyce | |
| D275,345 | S | 9/1984 | Hall | |
| 4,805,765 | A | 2/1989 | Barrett | |
| D302,949 | S | 8/1989 | Eisendrath | |
| 4,899,929 | A | 2/1990 | Grollman | |
| D312,179 | S | 11/1990 | De Luca | |
| D321,647 | S | 11/1991 | Oldorf | |
| 5,117,973 | A | 6/1992 | Lo Duca | |
| 5,249,737 | A | 10/1993 | Fritz | |
| D397,566 | S | 9/1998 | Choiniere | |
| 5,836,478 | A | 11/1998 | Weiss | |
| D403,188 | S | 12/1998 | Kancso | |
| D416,725 | S | 11/1999 | Lewis | |
| 6,062,424 | A | 5/2000 | Simile-Gravina | |
| D429,930 | S | 8/2000 | Phelps | |
| D430,438 | S | 9/2000 | Phelps | |
| D436,298 | S | 1/2001 | Tramontina | |
| D446,086 | S | 8/2001 | Tramontina | |
| D448,252 | S | 9/2001 | Tramontina | |
| D450,542 | S | 11/2001 | Tramontina | |
| D463,184 | S | 9/2002 | Tramontina | |
| 6,443,317 | B1 * | 9/2002 | Brozak, Jr. | A47F 7/021 211/85.1 |
| D463,929 | S | 10/2002 | Fitzsimmons | |
| D472,398 | S | 4/2003 | Sparkowski | |
| D475,873 | S | 6/2003 | Mello | |
| 6,902,104 | B2 | 6/2005 | Holley, Jr. | |
| D537,734 | S | 3/2007 | Wolpow | |
| D576,824 | S | 9/2008 | Eksröm | |
| D586,234 | S | 2/2009 | Lamoury | |
| D586,598 | S | 2/2009 | Tefel | |
| D605,442 | S | 12/2009 | Elhalwani | |
| 7,648,048 | B2 | 1/2010 | Smith | |
| 7,658,317 | B2 | 2/2010 | Wilkins | |
| 7,743,972 | B2 | 6/2010 | Fogle | |
| 8,136,697 | B2 | 3/2012 | Hackney | |
| D721,517 | S | 1/2015 | Hill | |
| 9,546,031 | B2 * | 1/2017 | Healy | B65D 77/0413 |
| 9,586,749 | B2 | 3/2017 | Schultz | |
| 9,796,499 | B2 | 10/2017 | Schultz | |
| D805,322 | S | 12/2017 | Johanson | |
| D811,771 | S | 3/2018 | Wallace | |
| 10,065,762 | B2 | 9/2018 | Schultz | |
| 10,098,787 | B2 | 10/2018 | Umentum | |
| 10,179,671 | B2 | 1/2019 | Umentum | |
| 10,239,683 | B2 | 3/2019 | Umentum | |
| D855,459 | S | 8/2019 | Martin | |
| D859,148 | S | 9/2019 | Toms, Jr. | |
| 10,405,705 | B2 | 9/2019 | Formon | |
| 10,543,955 | B1 * | 1/2020 | Turturro | B65D 5/724 |
| D885,789 | S | 6/2020 | Boeltl | |
| 10,669,062 | B2 | 6/2020 | Schultz | |
| D917,198 | S | 4/2021 | Xie | |
| D917,881 | S | 5/2021 | Spiegel | |
| D929,767 | S | 9/2021 | Turturro | |
| D930,389 | S | 9/2021 | Turturro | |
| D945,179 | S | 3/2022 | Ybarra | |
| D947,021 | S | 3/2022 | Garthaffner | |
| 11,273,951 | B1 | 3/2022 | Dubois | |
| 11,427,378 | B2 | 8/2022 | Schultz | |
| D976,108 | S | 1/2023 | Zatkoff | |
| D982,343 | S | 4/2023 | Turturro | |
| D1,008,018 | S | 12/2023 | Natsume | |
| D1,014,236 | S | 2/2024 | Kuo | |
| D1,020,451 | S * | 4/2024 | Valentine | D9/414 |
| D1,023,757 | S | 4/2024 | Okoshi | |
| D1,026,667 | S | 5/2024 | Chen | |
| D1,036,989 | S | 7/2024 | Garthaffner | |
| D1,039,122 | S | 8/2024 | Habbel | |
| D1,039,867 | S | 8/2024 | Liao | |
| D1,079,132 | S | 6/2025 | Suwanto | |
| D1,104,745 | S | 12/2025 | Emory | |
| D1,107,456 | S | 12/2025 | Chen | |
| D1,107,562 | S | 12/2025 | Finkelstein | |
| D1,116,819 | S | 3/2026 | Koretz | |
| 2004/0094568 | A1 | 5/2004 | Dailey, III | |
| 2006/0027639 | A1 | 2/2006 | Rasmussen | |
| 2006/0249529 | A1 | 11/2006 | Smalley | |
| 2009/0272756 | A1 | 11/2009 | Hackney | |
| 2012/0091163 | A1 | 4/2012 | Lowry | |
| 2014/0319205 | A1 * | 10/2014 | Schultz | B65D 5/0245 229/122.1 |
| 2015/0191296 | A1 | 7/2015 | Umentum | |
| 2015/0203282 | A1 * | 7/2015 | Umentum | B65D 5/724 221/259 |
| 2018/0370680 | A1 | 12/2018 | Shultz | |
| 2019/0039776 | A1 * | 2/2019 | Kioroglou | B65D 5/4208 |
| 2020/0069121 | A1 | 3/2020 | Boeltl | |
| 2020/0317391 | A1 * | 10/2020 | Schultz | B65D 5/725 |

FOREIGN PATENT DOCUMENTS

| | | |
|---|---|---|
| GB | 90023050780003 | 10/2013 |
| GB | 6117761 | 2/2021 |
| JP | J6247137 | 12/2017 |
| JP | 1724407 | 9/2022 |
| KR | 3019920018130 | 9/1993 |
| KR | 3010234390000 | 9/2019 |
| KR | 3020220031316 | 9/2022 |

OTHER PUBLICATIONS

Guomao Kitchen Bathroom Storage Box Kitchen Garbage Bag Storage Box Wall-Mounted Plastic Bag Storage Box https://amzn.asia/d/3Ts9H2z, Sep. 5, 2019 (Year: 2019).

(56) References Cited

OTHER PUBLICATIONS

Marketlab Inc. Cap and Shoe Cover Dispenser, https://punchout.medline.com/product/Cap-and-Shoe-Cover-Dispenser-by-Marketlab/Surgical-Caps/Z05-PF127849, Tin Eye: Feb. 13, 2016 (Year: 2016).
TIDI Shield Grab N Go Eye Shield 100ct. Site visted: Feb. 10, 2025. Available online: https://athome.medline.com/es/tidi-shield-grab-n-go-eye-shield-100ct-Ipc9210a100 (Year: 2025).
AHS Eye Shield Dispenser, AHS, [Post date unknown], [Site seen: Jan. 8, 2026], URL: https:// www.american-hospitalsupply.com/products/ahs-eye-shield-dispenser, cited by examiner in U.S. Appl. No. 29/896,314 and given a date of 2026 (Year: 2026).
Frame and Lens Dispenser, Medline, [Post date: Mar. 18, 2025], [Site seen: Jan. 8, 2026], URL: https:// www.medline.com/product/F rame-and-Lens-Dispenser/Z05-P F88181, cited by examiner in U.S. Appl. No. 29/896,314 and given a date of 2025, [Post date: Mar. 18, 2025], [Site seen: Jan. 8, 2026] (Year: 2025).
TIDI Shield Grab N'Go Eyewear Dispensers, Medline, [Post date: unknown], [Site seen: Jan. 8, 2026], URL: https://www.medline.com/product/TIDIShield-Grab-n-Go-Eyewear-Dispensers/Z05-PF75115, cited by examiner in U.S. Appl. No. 29/896,314 and given a date of 2026 [Post date: unknown], [Site seen: Jan. 8, 2026] (Year: 2026).
Medline: Eye Shield Dispenser, javascript posted Dec. 21, 2023 [online], [retrieved] Apr. 24, 2026], retrieved from internet, http://www.amazon.sg/Medline-Shield-Dispensers-Shields/dp/B0CqPJNRRW8, (2023) (Year: 2023).
Dispenser Box Cardboard Display Box Template Stock Vector (Royalty Free) 1342223072 | Shutterstock. Date first available: Sep. 5, 2025. Site visited: May 19, 2026. Available online: https://www.shutterstock.com/image-vector/dispenser-box-cardboard-display-template-die-1342223072 (Year: 2025).

* cited by examiner

DISPENSER FOR EYE SHIELDS

FIELD

The disclosure relates generally to the field of dispensers, in particular, eye shields and other similarly sequentially dispensed products.

BACKGROUND

Disposable eye shields are used in a variety of settings, including clinical and medical settings. Eye shields provide protection from particles that may cause damage to the eyes, such as splattering fluids. Such eye shields are typically packaged and dispensed from disposable containers, each container holding a quantity of eye shields that may be used in a procedure of interest and discarded thereafter.

In some eye shield dispensers, the eye shields may become disorganized or jumbled within the dispenser and thereby difficult to remove. In part, this concern is addressed by the eye shield dispenser disclosed in U.S. Pat. No. 10,543,955 B1, issued to Medline Industries, Inc. (now Medline Industries, LP). This patent discloses an eye shield dispenser formed from a packaging blank having plural panels that may be assembled via folding to form a dispenser. The dispenser disclosed therein is loadable from the top of the dispenser and is gravity operated. Users remove eye shields sequentially from a bottom opening on the dispenser and the remaining eye shields in the dispenser fall sequentially to the bottom surface of the dispenser until the supply of eye shields is exhausted.

Now provided is an eye shield dispenser that is gravity fed and also that is front-loading. This configuration facilitates loading of eye shields into the dispenser during initial packaging of eye shields or during reloading of the dispenser with replacement eye shields, while maintaining the gravity-fed simple operation of the device.

DETAILED DESCRIPTION

Figure 1:
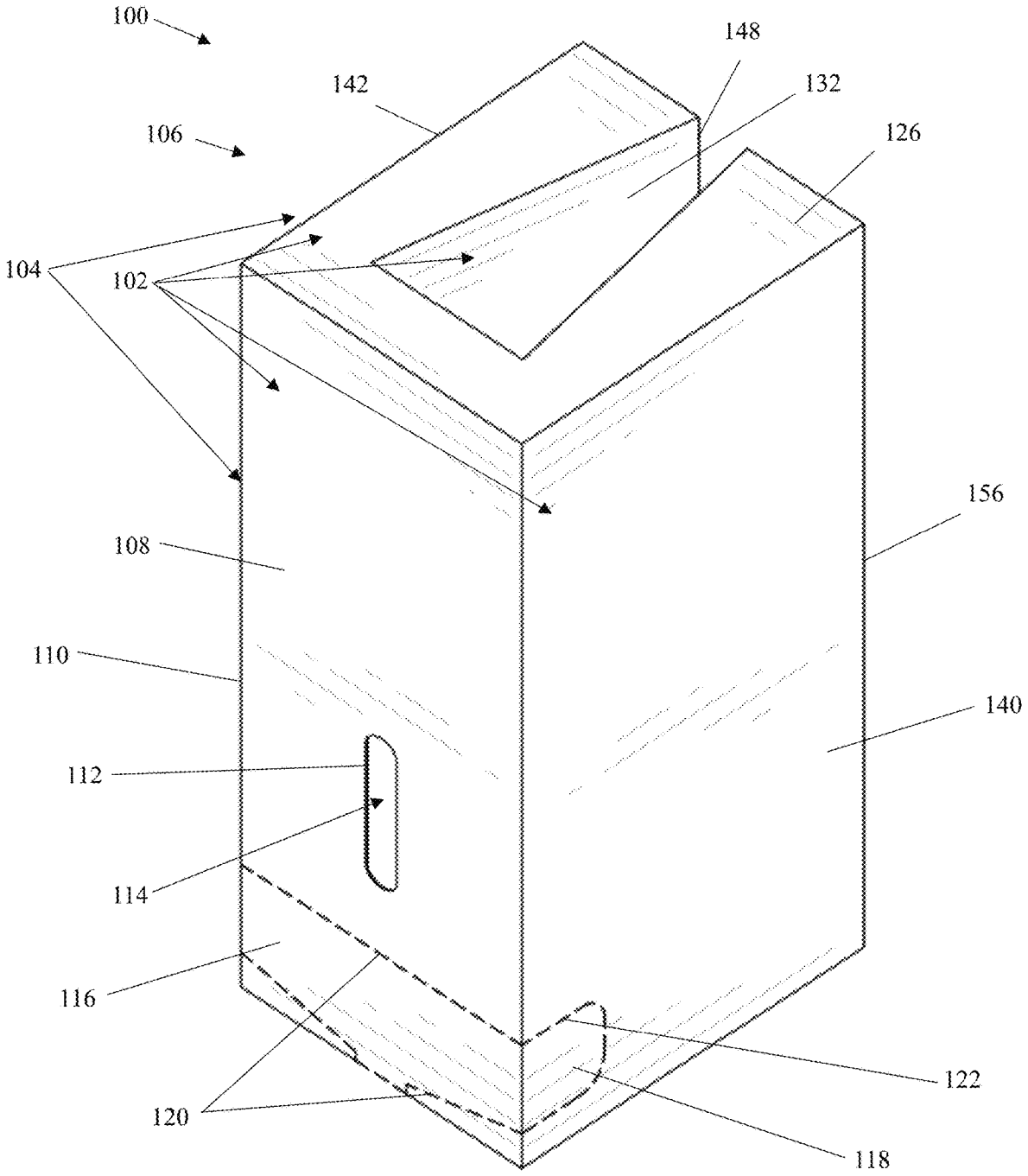
FIG. 1 is a view in military perspective illustrating a representative dispenser, the dispenser being shown in a sealed configuration.
Figure 3:
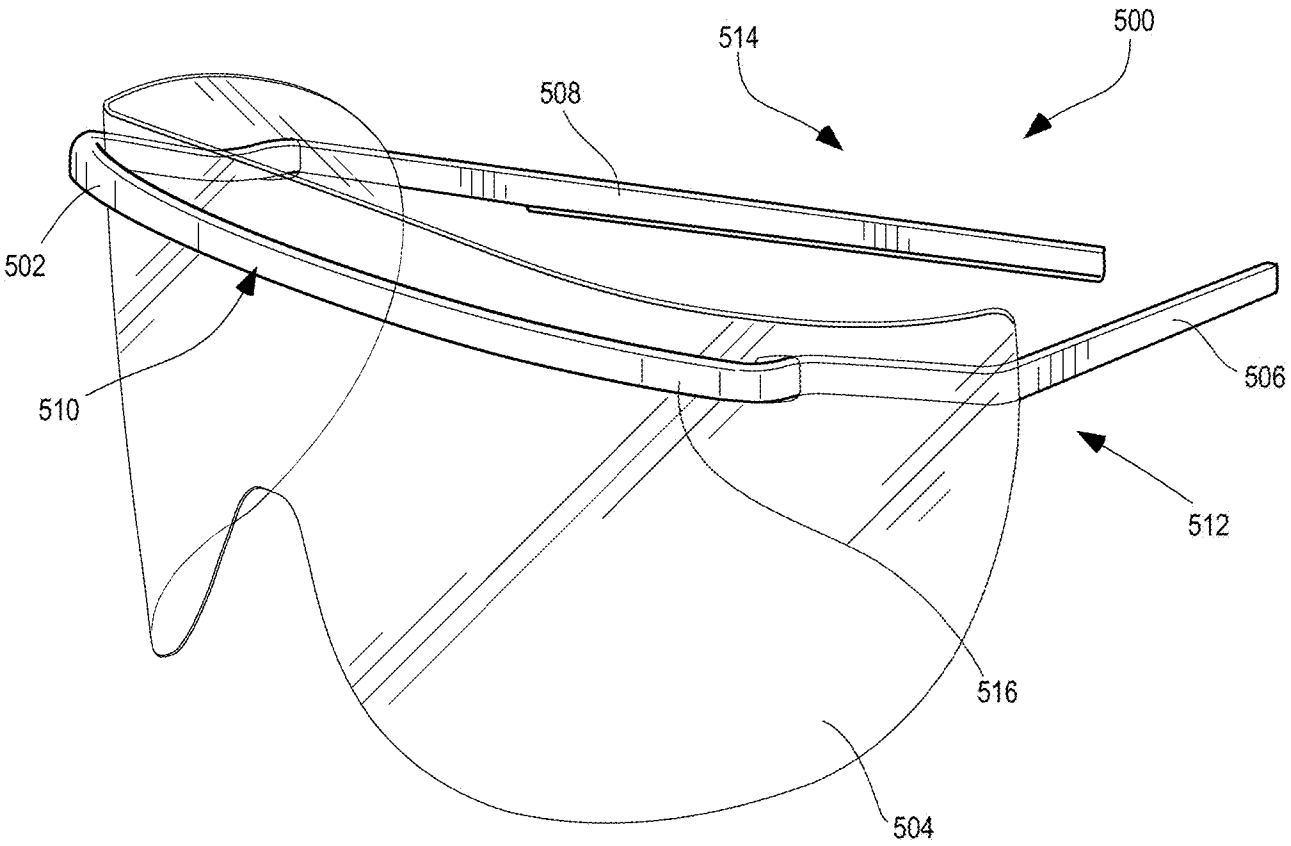
FIG. 3 is a perspective view of a typical eye shield.

The dispenser 100 shown in FIG. 1 includes a plurality of panels including panels 102 interconnected via a plurality of fold lines including fold lines 104. Generally the dispenser includes a body 106 formed by folding the plurality of panels 102 together along the plurality of fold lines 104 and securing attachment portions of the plurality of panels 102 to each other or one or more of the plurality of panels 102. As shown in FIG. 1, the body 106 has a U-shaped cross-section having a profile generally analogous to the letter U with arms sized to accommodate eye shield temple portions (FIG. 3). A front panel 108 of the plurality of panels 102 is connected to and contiguous with only a single other one of the plurality of panels 102 along a hinge line 110 of the plurality of fold lines 104. Further, the front panel 108 has a slot 112 extending along a longitudinal direction of the front panel 108. The slot 112 provides visual access to an interior 114 of the body 106 defined by the plurality of panels 102 as folded. The interior 114 is configured to hold a plurality of eye shields 500 (see FIG. 3) in a stacked configuration. The slot 112 also enables a user to approximate how many eye shields 500 (see FIGS. 3 and 5) remain within the dispenser 100.

Additionally, the front panel 108 includes a first access panel 116 disposed at least partially within the front panel 108. A second access panel 118 is disposed in a second outer side panel 140 of the plurality of panels 102. The first access panel 116 and the second access panel 118 are configured to be removed from the front panel 108 and the second outer side panel 140 respectively to grant access to the interior 114. In particular, the first access panel 116 and the second access panel 118 can be connected to the front panel 108 and the second outer side panel 140 by first perforations 120 and second perforations 122, respectively. The first perforations 120 and second perforations 122 are configured to tear aways from the front panel 108 and the second outer side panel 140, respectively, to facilitate removal of the first access panel 116 and the second access panel 118 from the dispenser 100.

Figure 2:
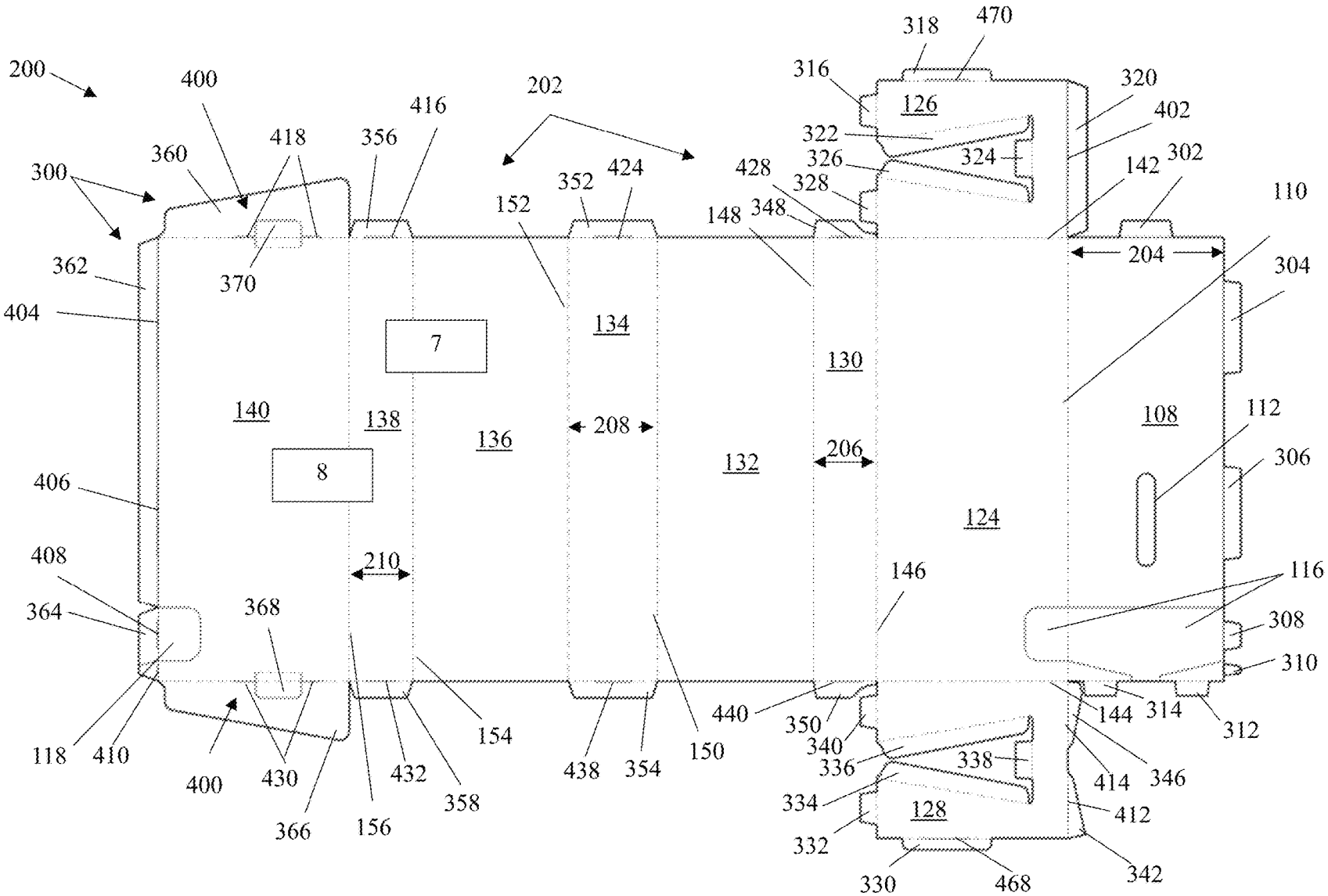
FIG. 2 is a top plan view of a blank foldable and sealable to form the eye shield dispenser of FIG. 1.

With reference now to FIG. 2, a blank 200 is shown. The blank 200 has a contiguous sheet 202 in which the plurality of panels 102 (see FIG. 1) and the plurality of fold lines 104 (see FIG. 1) are defined. The contiguous sheet 202 is formed foldable material that is processed to include the plurality of fold lines 104 that define the plurality of panels 102 may be folded to form the body 106. The blank 200 may be cut from a blank sheet of material such as cardboard or cardstock and may be scored using conventional techniques to provide the plurality of fold lines 104. A first outer side panel 124, a top panel 126, a bottom panel 128, a first outside rear panel 130, a first inner side panel 132, an inner rear panel 134, a second inner side panel 136, a second outside rear panel 138, and the second outer side panel 140.

Further, the plurality of fold lines 104 (see FIG. 1) include a first fold line 142, a second fold line 144, a third fold line 146, a fourth fold line 148, a fifth fold line 150, a sixth fold line 152, a seventh fold line 154, and an eighth fold line 156. As shown in FIG. 2 the top panel 126 is contiguous with the first outer side panel 124 along the first fold line 142, the bottom panel 128 is contiguous with the first outer side panel 124 along the second fold line 144, the first outside rear panel 130 is contiguous with the first outer side panel 124 along the third fold line 146, the first inner side panel 132 is contiguous with the first outside rear panel 130 along the fourth fold line 148, the inner rear panel 134 is contiguous with the first inner side panel 132 along the fifth fold line 150, the second inner side panel 136 is contiguous with the inner rear panel 134 along the sixth fold line 152, the second outside rear panel 138 is contiguous with the second inner side panel 136 along the seventh fold line 154, and the second outer side panel 140 is contiguous with the second outside rear panel 138 along the eighth fold line 156. The blank 200 as shown in FIG. 2 can be folded in two different manners to form the dispenser 100 shown in FIG. 1. First, the blank 200 can be folded in a direction into the page such that the first outer side panel 124 is on the right hand side of the dispenser 100 as viewed from a rear of the dispenser 100, as shown in the Figures. Second, the blank 200 can be folded in a direction out of the page such that the first outer side panel 124 is on the left hand side of the dispenser 100 as viewed from the rear of the dispenser. Artwork or printed indicia applied to the panels (not shown) may dictate the direction of folding.

Other configurations and arrangements of the plurality of panels 102 and plurality of fold lines 104 within the contiguous sheet 202 are possible. For example, the second outer side panel 140, the top panel 126, the bottom panel 128, etc. can comprise the single other one of the plurality of panels 102 that the front panel 108 is contiguous along the hinge line 110.

Still with reference to FIG. 2, the attachment portions of the plurality of panels 102 can include a plurality of flaps 300 and a plurality of slots 400. Each of the plurality of flaps 300 are contiguous with one of the plurality of panels 102 along a respective one of the plurality of fold lines 104. Further, each of the plurality of slots 400 are cutouts along a respective one of the plurality of fold lines 104 and are configured to receive a respective one of the plurality of flaps 300. In particular, the front panel 108 includes flaps 302, 304, 306, 308, 310, 312, and 314. The top panel 126 includes flaps 316, 318, 320, 324, 322, 324, 326, and 328. The bottom panel 128 includes flaps 330, 332, 334, 336, 338, 340, 342, and 346. The first outside rear panel 130 includes flaps 348 and 350. The inner rear panel 134 includes flaps 352 and 354. The second outside rear panel 138 includes flaps 346 and 358. The second outer side panel 140 includes flaps 360, 362, 364, 366, 368, and 370. As shown in FIG. 2, the flaps 368 and 370 are partially cutout from and nest within the flaps 366 and 360, respectively.

A slot 402 is disposed along the fold line joining the flap 320 to the top panel 126 and is configured to receive the flap 302 when the blank 200 is folded to form the dispenser 100. Slots 404 and 406 are disposed along the fold line joining the flap 362 to the second outer side panel 140 and are configured to receive the flaps 304 and 306, respectively when the blank 200 is folded to form the dispenser 100. A slot 408 is disposed along the fold line joining the flap 364 to the second outer side panel 140 and is configured to receive the flap 308 when the blank 200 is folded to form the dispenser 100. Further, a portion of the flap 364 and the slot 408 can be part of the second access panel 118 and can thus be removed from the dispenser 100 when the second access panel 118 is removed to grant access to the interior 114 (see FIGS. 1, 5, 6, and 12). A slot 410 is also disposed along the fold line joining the flap 364 to the second outer side panel 140 disposed along the fold line joining the flap 310 when the blank 200 is folded to form the dispenser 100. However, unlike the slot 408, the slot 410 resides in a portion of the flap 364 that is not a part of the second access panel 118, and thus will remain associated with the body 106 after the second access panel 118 is removed.

A slot 412 is disposed along the fold line joining the flap 342 to the bottom panel 128 and is configured to receive the flap 312 when the blank 200 is folded to form the dispenser 100. A slot 414 is disposed along the fold line joining the flap 346 to the bottom panel 128 and is configured to receive the flap 314 when the blank 200 is folded to form the dispenser 100. A slot 418 is disposed along the fold line joining the flap 360 to the second outer side panel 140 and is configured to receive the flap 318 when the blank 200 is folded to form the dispenser 100. As shown in FIG. 2, the slot 418 can be bifurcated by the flap 370. A slot 424 is disposed along the fold line joining the flap 352 to the inner rear panel 134 and is configured to receive the flap 324 when the blank 200 is folded to form the dispenser 100. A slot 428 is disposed along the fold line joining the flap 348 to the first outside rear panel 130 and is configured to receive the flap 328 when the blank 200 is folded to form the dispenser 100. A slot 430 is disposed along the fold line joining the flap 366 to the second outer side panel 140 and is configured to receive the flap 330 when the blank 200 is folded to form the dispenser 100. As shown in FIG. 2, the slot 430 can be bifurcated by the flap 368. A slot 432 is disposed along the fold line joining the flap 358 to the second outside rear panel 138 and is configured to receive the flap 332 when the blank 200 is folded to form the dispenser 100. A slot 440 is disposed along the fold line joining the flap 350 to the first outside rear panel 130 and is configured to receive the flap 340 when the blank 200 is folded to form the dispenser 100. A slot 468 is disposed along the fold line joining the flap 330 to the bottom panel 128 and is configured to receive the flap 368 when the blank 200 is folded to form the dispenser 100. A slot 470 is disposed along the fold line joining the flap 318 to the top panel 126 and is configured to receive the flap 370 when the blank 200 is folded to form the dispenser 100.

An adhesive such as glue, tape, or the like may be used on the plurality of flaps 300 for maintaining the assembly of the dispenser 100 after the blank 200 is folded to form the dispenser 100 and the body 106. However, in order to enable the front panel 108 to open and close along the hinge line 110, adhesive can be withheld from at least the flaps 302, 304, 306, and 308. In some embodiments, in order to prevent the front panel 108 from inadvertently opening along the hinge line 110, a form of non-permanent adhesive can be used to temporarily secure the front panel 108 in the closed position (see FIGS. 1, 4, and 5) This non-permanent adhesive can include tape that crosses over the front panel 108 to the second outer side panel 140. Additionally or alternatively, the non-permanent adhesive can include tape or other similar adhesives applied to the flaps 302, 304, 306, and 308 in a non-permanent manner that enables the flaps 302, 304, 306, and 308 to be removed from the slots 402, 404, 406, and 408 when the front panel 108 is opened (see FIGS. 11 and 12).

The eye shield 500 shown in FIG. 3 typically includes a frame portion 502 and a fluid barrier portion 504. The frame portion 502 is superior to the fluid barrier portion 504 in ordinary use but typically is inverted when positioned in the dispenser in ordinary use. The eye shield 500 includes temple portions 506, 508 that generally taper rearwardly, and which are structured such that the eye shield 500 has a wide front region 510, a slightly wider intermediate region 512, and a narrower rear region 514. The frame material of the eye shield 500 is typically a flexible elastomeric plastic such that the temple portions 506, 508 are caused to grip onto the face of a user to hold the eye shield 500 in place during use. In use, a stacked configuration of multiple one of the eye shield 500 are disposed in the dispenser 100 in an upside-down configuration, i.e., such that an upper side 516 of the frame portion 502 contacts and rests on the bottom panel 128 (see FIG. 5).

Figure 4:
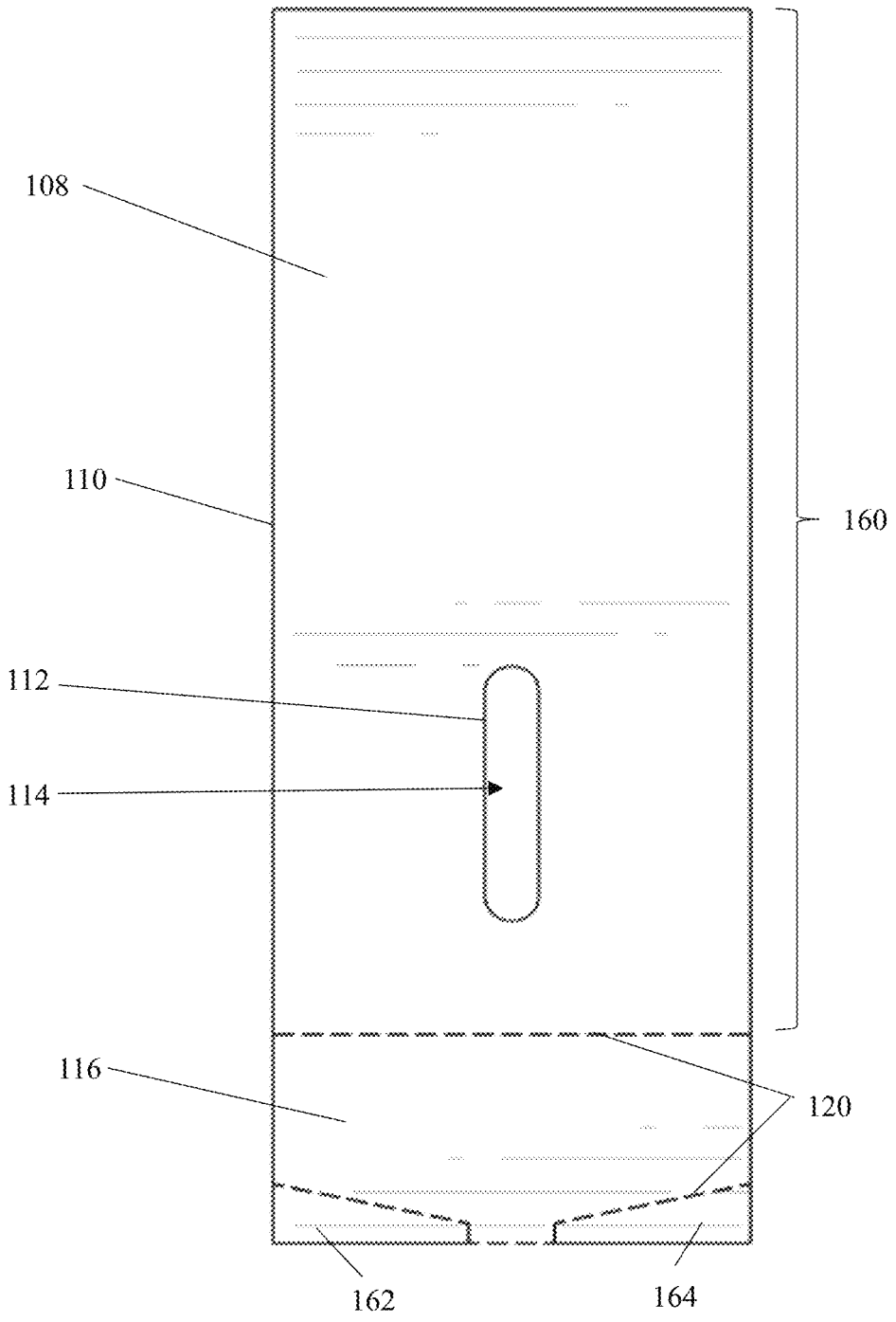
FIG. 4 is a front elevation of the eye shield dispenser shown in FIG. 1.
Figure 5:
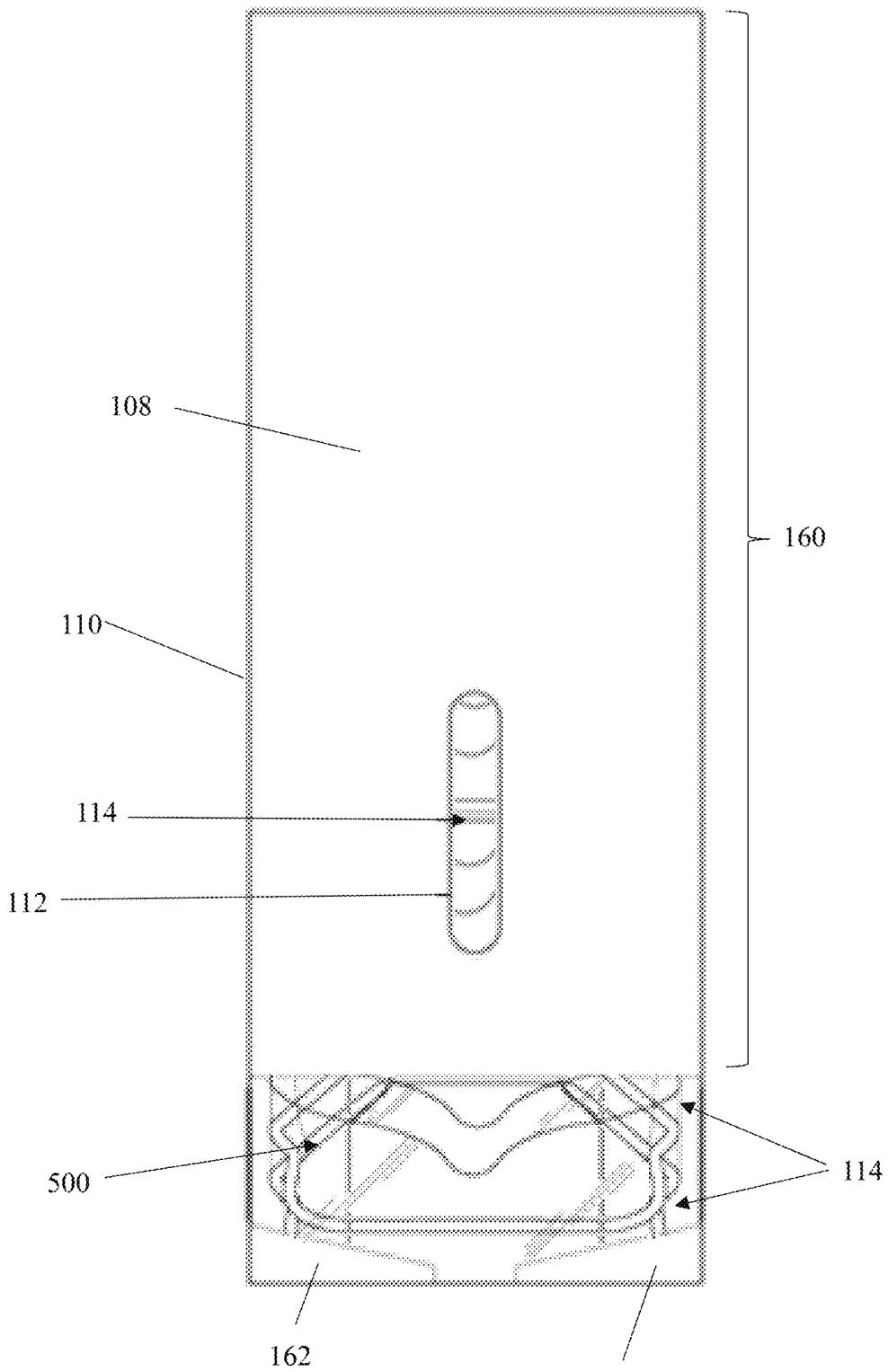
FIG. 5 is a front elevation of the dispenser shown in FIGS. 1 and 2, shown in an unsealed configuration where an access panel has been opened to allow users to remove eye shields therefrom.
Figure 6:
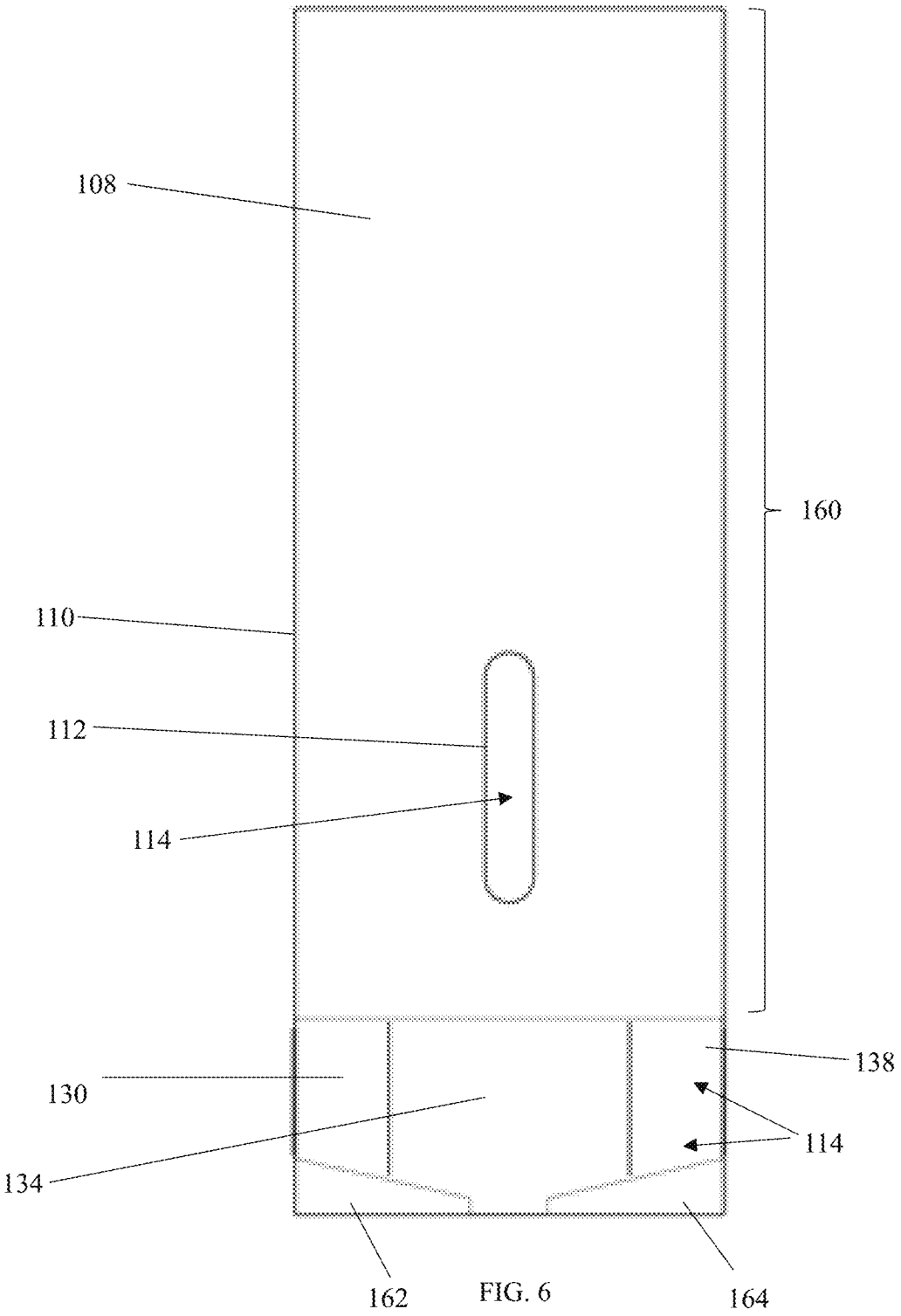
FIG. 6 is a front elevation of the dispenser shown above, shown empty after all of the eye shields have been removed therefrom.

As shown in FIG. 4, the front panel 108 is dived by the first access panel 116 into an upper portion 160, a first lower portion 162, and a second lower portion 164. As shown in FIG. 5, the first access panel 116 and the second access panel 118 (see FIG. 1) can be removed to reveal the interior 114 and a plurality of the eye shields 500 that have been stacked within the dispenser 100. The plurality of the eye shields 500 are stacked such that when a first eye shield 500 is removed from the interior 114 via an access port opened by removal of the first access panel 116 and the second access panel 118 (see FIG. 1), another eye shield 500 will be gravity-fed into substantially the same place as the removed eye shield 500 for subsequent removal. As shown in FIGS. 5 and 6, when the stacked configuration of the eye shields 500 can be positioned such that the temple portions 506, 508 extend back towards the first outside rear panel 130 and the second outside rear panel 138 while the fluid barrier portion 504 rests against or proximate to the inner rear panel 134.

Figure 7:
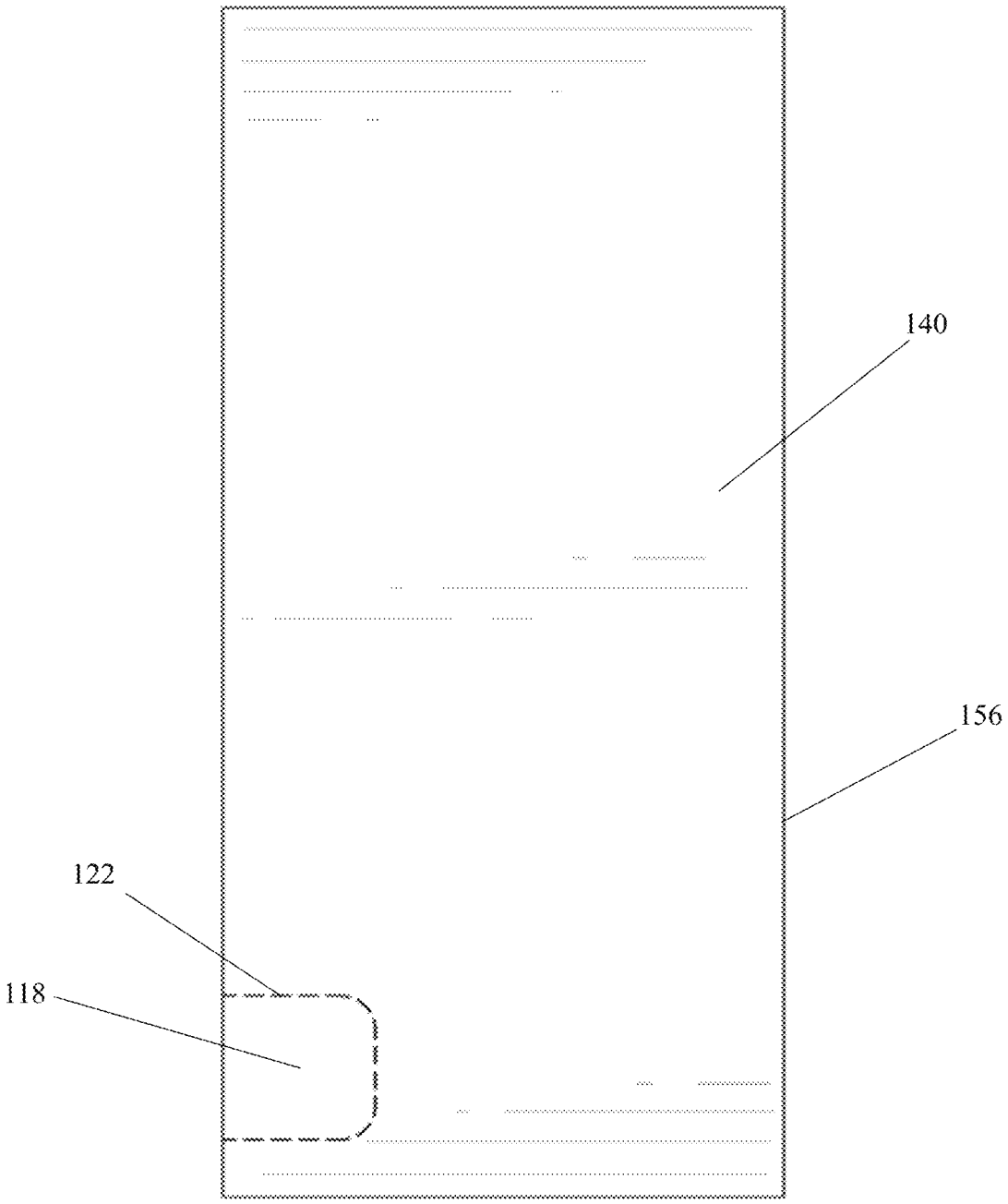
FIG. 7 is a left side elevation of the dispenser illustrated above.
Figure 8:
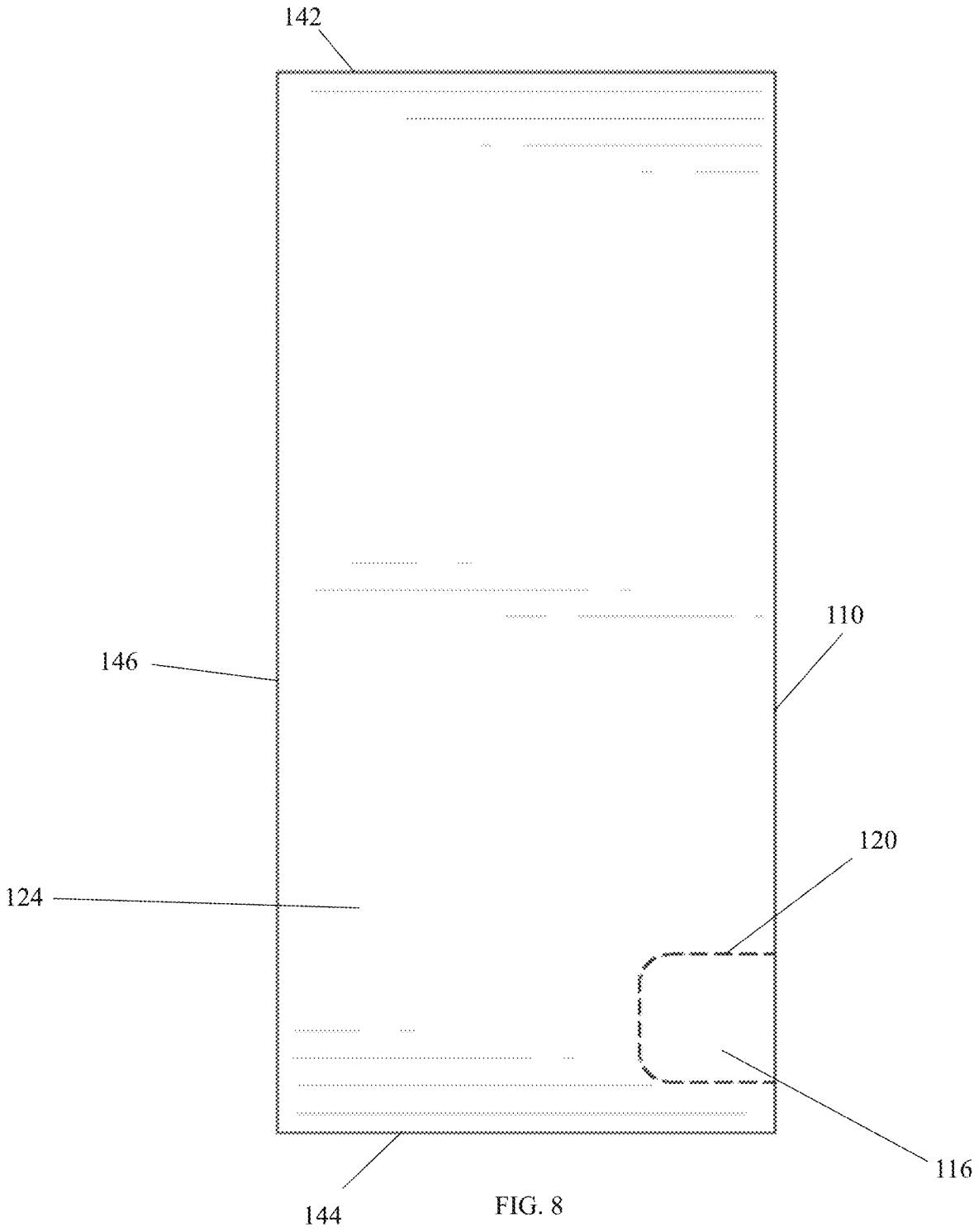
FIG. 8 is a right side elevation of the dispenser illustrated above.

With reference now to FIGS. 7 and 8*and* continued reference to FIGS. 1 and 2, the second access panel 118 that is formed in the second outer side panel 140 can align with or join to the first access panel 116 to present the appearance of an integral signal access panel to a user of the dispenser 100. Further, the first access panel 116 can cross over the hinge line 110 to the single other one of the plurality of panels to which the front panel 108 is joined (e.g. the first outer side panel 124 as shown in FIGS. 2 and 8). As shown in FIGS. 7 and 8, the portion of the first access panel 116 that crosses over to the first outer side panel 124 can have a profile similar to the second access panel 118 to provide the dispenser 100 with a symmetrical appearance to the user.

Figure 9:
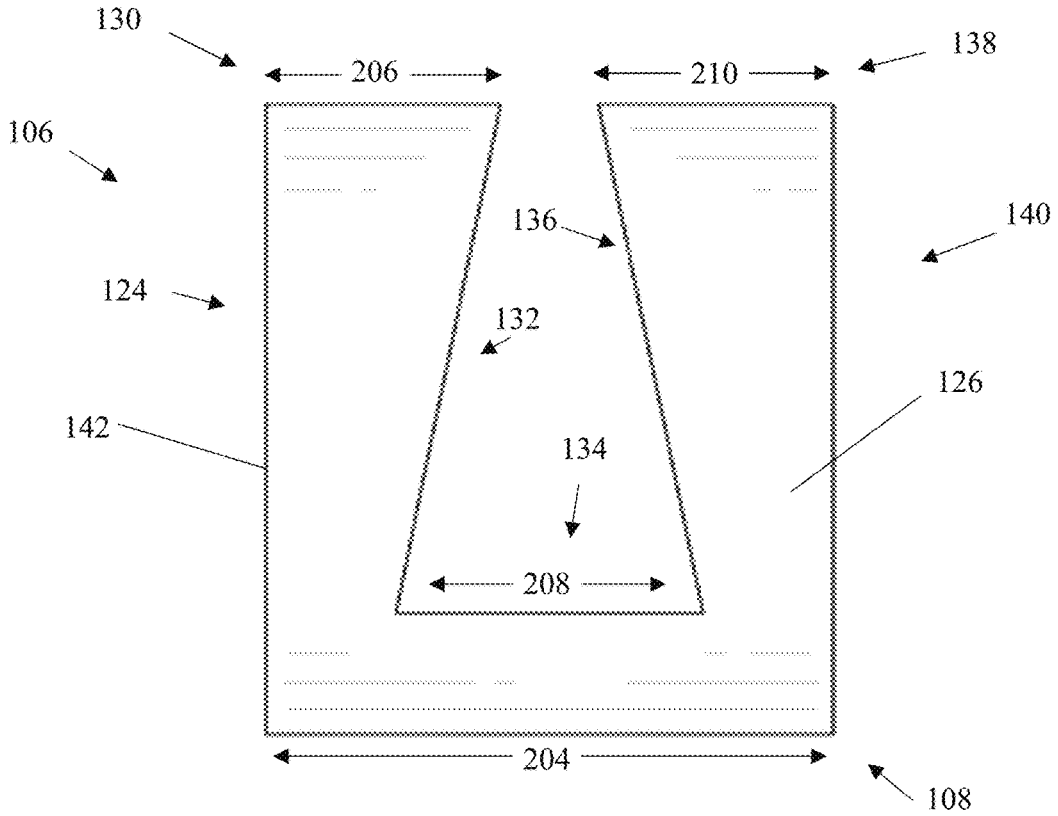
FIG. 9 is a top plan view of the dispenser illustrated above.
Figure 10:
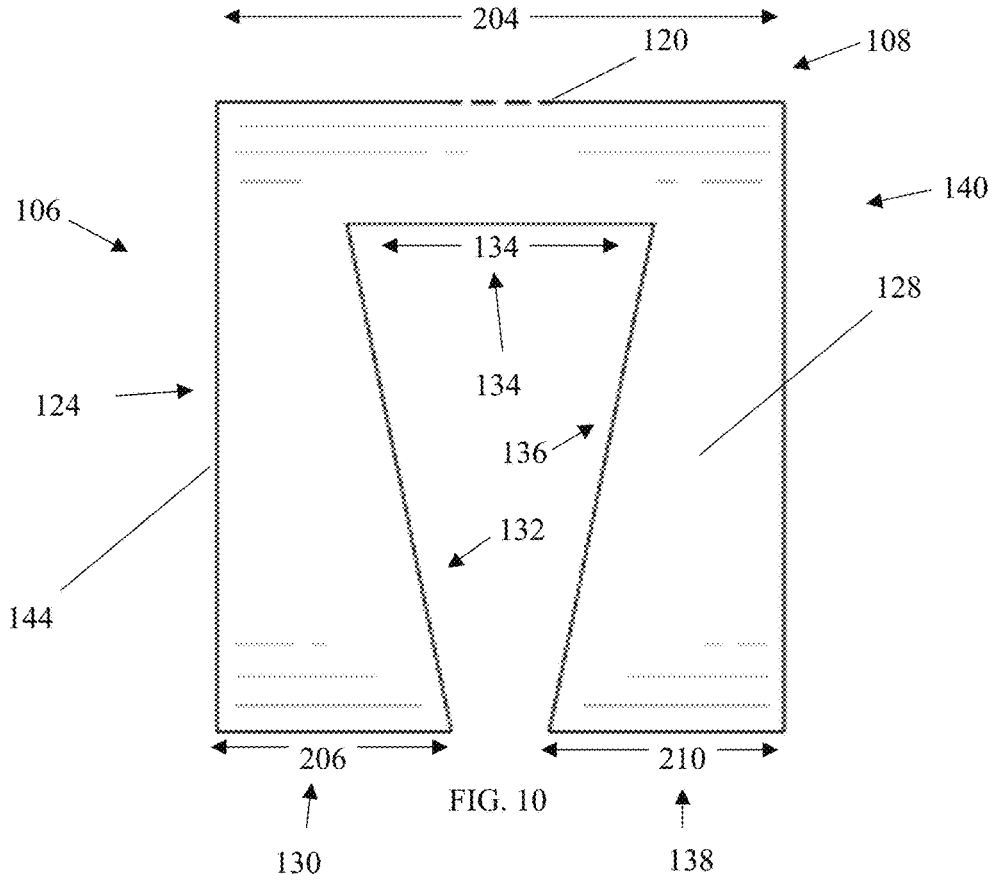
FIG. 10 is a bottom plan view of the dispenser illustrated above.

With reference now to FIGS. 9, and 10 and continued reference to FIG. 2, it is shown that the front panel 108 has a width 204, the first outside rear panel 130 has a width 206, the inner rear panel 134 has a width 208, and the second outside rear panel 138 has a width 210. The combination of the widths 206, 208, and 210 is greater than the width 204 of the front panel as FIGS. 2, 9, and 10. This difference in widths causes portions of the body 106 formed between the first outer side panel 124 and the first inner side panel 132 and between the second outer side panel 140 and the second inner side panel 136 to have an increasing width dimension from the junctions of the inner rear panel 134 with the first inner side panel 132 and the second inner side panel 136 out to the first outside rear panel 130 and the second outside rear panel 138, respectively. This increasing width dimension can accommodate temple portions 506 and 508 of the eye shield 500 that converge as they progress away from the wide front region 510 (see e.g. FIG. 3).

Figure 11:
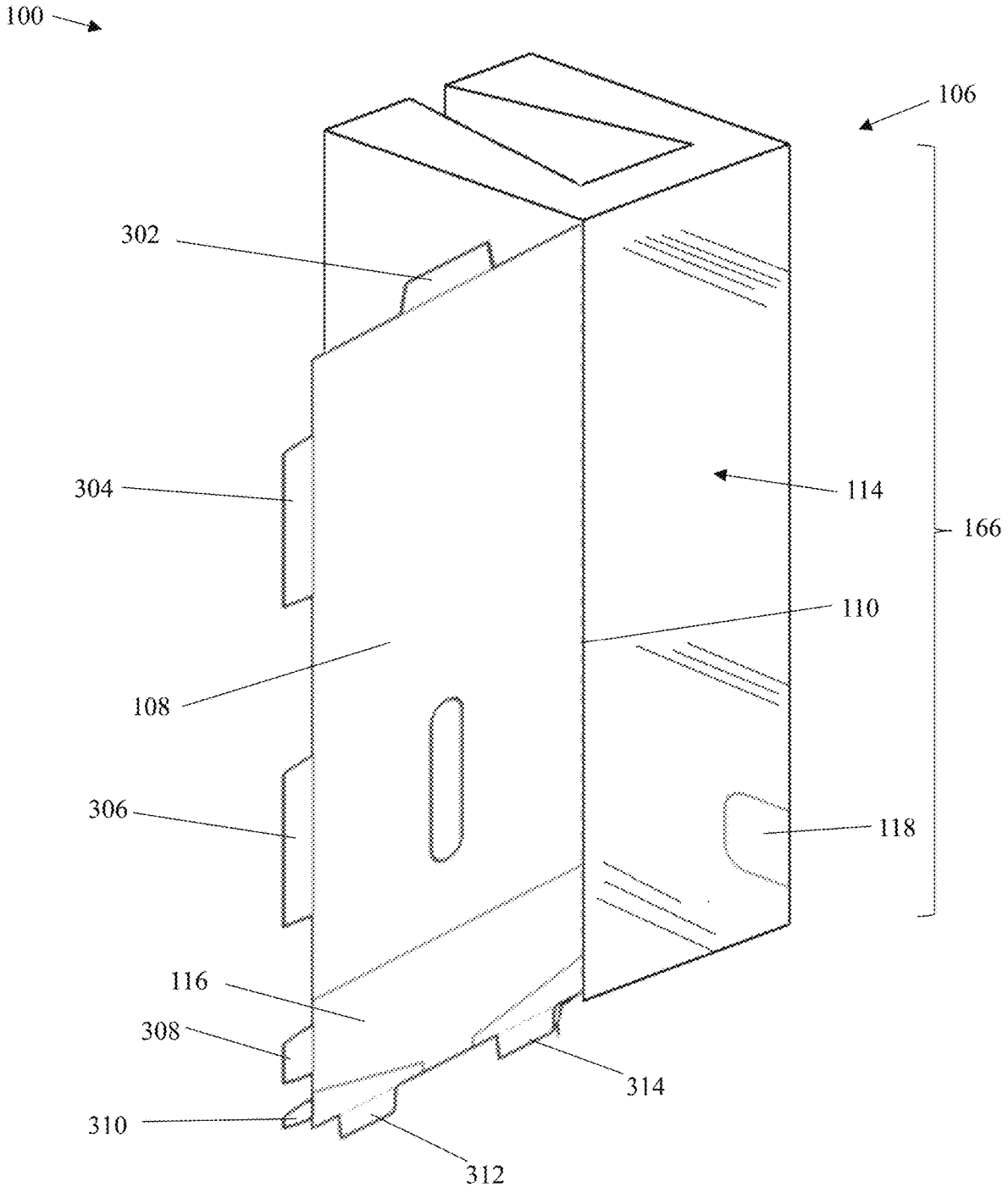
FIG. 11 is a perspective view of the dispenser shown above, shown with the front panel in an open position for initial loading of eye shields therewithin.
Figure 12:
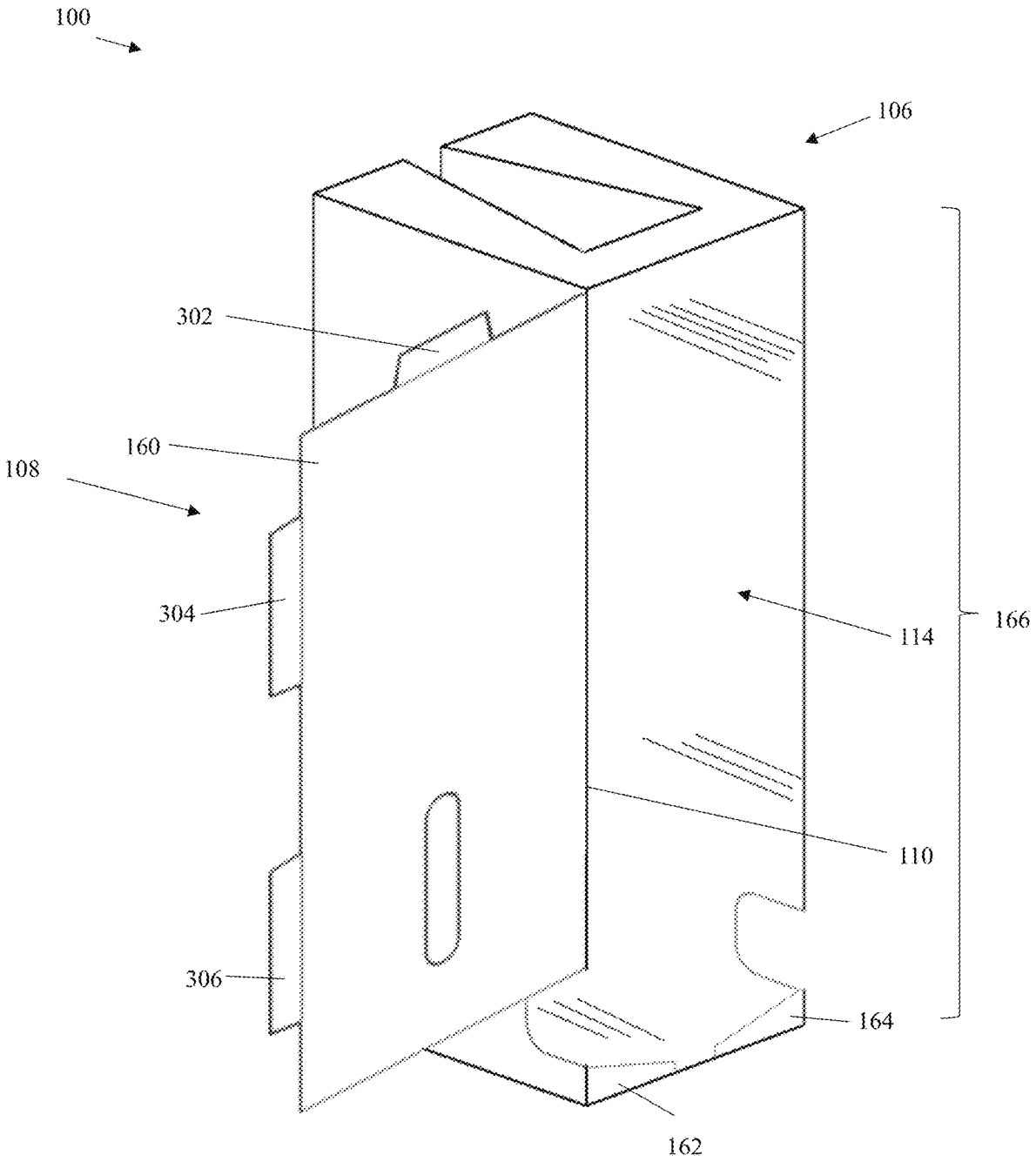
FIG. 12 is a perspective view of the dispenser shown in FIG. 11, shown with the front panel open for reloading of eye shields therein after the initially loaded eye shields have been previously dispensed.

With reference now to FIGS. 11 and 12, it is shown that the front panel 108 is configured to hingedly move via the hinge line 110 to expose the interior 114 of the body 106 along a height dimension 166 thereof and enable access thereto for loading the plurality of eye shields 500 within the interior 114 of the body 106. The height dimension 166 can be a maximum dimension of the interior 114 of the body 106. Further, as seen in FIG. 2, the front panel 108, the first outer side panel 124, the first outside rear panel 130, the first inner side panel 132, the inner rear panel 134, the second inner side panel 136, the second outside rear panel 138 and the second outer side panel 140 can have a same respective height dimension as the height dimension 166 of the interior of the body.

As shown in FIG. 11, after an initial folding of the blank 200, the entirety of the front panel 108 including the first access panel 116 remains open and intact for loading of a stacked configuration of eye shields 500 inside the interior 114. Once the stacked configuration is loaded, the whole front panel 108 can be closed to enclose the stacked configuration within the interior 114. As described above, in some embodiments, the flaps 302, 304, 306, and 308 can be secured within the corresponding slots 402, 404, 406, and 408 (see FIG. 2) without any adhesive to enable the upper portion 160 of the front panel 108 to hingedly open again for refiling the dispenser 100 as shown in FIG. 12. It is seen that the access panels 116, 118 have been removed in previous use. The dispenser may be refilled and the front panel 108 then may be closed. The flaps 310, 312, and 314 can be secured within the slots 410, 412, and 414 using the adhesives as described herein such that the first lower portion 162 and the second lower portion 164 remain fixed when the upper portion 160 is opened to refill the dispenser 100. Alternatively, some or all of the flaps 310, 312, and 314 can also be secured without adhesive to facilitate easier reloading of the replacement eye shields 500.

The dispenser 100 as described herein can be used in conjunction with a method for loading a stacked configuration of the eye shields 500 thereinto. The method comprises providing the dispenser 100 in any of the configurations described herein. Then the method includes loading a first stacked configuration of the eye shields 500 into the interior 114 of the body 106 through an opening exposed along the height dimension 166. Then, the method includes closing the front panel 108 along the hinge line 110 to enclose the first stacked configuration of eye shields 500 within the interior 114 of the body 106. In some embodiments, this initial enclosure can be done by the manufacturer of the dispenser 100. In some embodiments, after removal of eye shields from the dispenser, a user may filled with shields 500 by a different entity then the manufacturer. In these embodiments, the method may include first opening the front panel 108 along the hinge line 110 to enable access to the interior 114.

The method can also include removing the first access panel 116 and/or the second access panel 118 to reveal a first one of the first stacked configuration of eye shields 500 from within the interior of the body as shown in for example FIG. 5. Then, after some number of the first stacked configuration of eye shields 500 are removed, the method can include reopening at least a portion of the front panel 108 (e.g., the upper portion 160) to expose the interior 114 of the body 106 along the height dimension 166 thereof. After the reopening, the method can include loading a second stacked configuration of the eye shields 500 into the interior 114 of the body 106 and closing the front panel 108 or the upper portion 160 to at least partially enclose the second stacked configuration of eye shields 500 within the interior 114 of the body 106.

Uses of singular terms such as "a," "an," are intended to cover both the singular and the plural, unless otherwise indicated herein or clearly contradicted by context. The terms "comprising," "having," "including," and "containing" are to be construed as open-ended terms. Any description of certain embodiments as "preferred" embodiments, and other recitation of embodiments, features, or ranges as being preferred, or suggestion that such are preferred, is not deemed to be limiting. The invention is deemed to encompass embodiments that are presently deemed to be less preferred and that may be described herein as such. All methods described herein can be performed in any suitable order unless otherwise indicated herein or otherwise clearly contradicted by context. The use of any and all examples, or exemplary language (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. The description herein of any reference or patent, even if identified as "prior," is not intended to constitute a concession that such reference or patent is available as prior art against the present invention. No unclaimed language should be deemed to limit the invention in scope. Any statements or suggestions herein that certain features constitute a component of the claimed invention are not intended to be limiting unless reflected in the appended claims. Neither the marking of the patent number on any product nor the identification of the patent number in connection with any service should be deemed a representation that all embodiments described herein are incorporated into such product or service.

What is claimed is:

1. A dispenser for eye shields comprising:

a plurality of panels interconnected via a plurality of fold lines defined in a contiguous blank;

a body having a U-shaped cross-section, the body formed by folding the plurality of panels together along the plurality of fold lines and securing attachment portions of the plurality of panels to each other or one or more of the plurality of panels;

an interior of the body defined by the plurality of panels as folded, the interior of the body configured to hold a plurality of eye shields in a stacked configuration; and a first access panel disposed at least partially within a front panel of the plurality of panels, wherein the first access panel is configured to be removed to grant access to the interior of the body, wherein the front panel is contiguous with only a single other one of the plurality of panels along a hinge line of the plurality of fold lines, and wherein the front panel is configured to hingedly move via the hinge line to expose the interior of the body to enable access thereto for loading the plurality of eye shields within the interior of the body, wherein the plurality of panels include a second outer side panel, a second inner side panel, a first outer side panel, a first inner side panel, an inner rear panel, a first outside rear panel, and a second outside rear panel, a top panel, and a bottom panel, and wherein the first inner side panel and second inner side panel each connect to the inner rear panel, the first inner side panel and second inner side panel obliquely disposed relative to one another and configured to extend in a converging manner away from the inner rear panel.

2. The dispenser of claim 1 further comprising the plurality of eye shields disposed in the interior of the body such that when a first one of the plurality of eye shields is removed from the interior through an access port another one of the plurality of eye shields will be gravity fed down along a height dimension of the interior of the body into substantially the same place as the removed eye shield.

3. The dispenser of claim 1 wherein the first access panel crosses over the hinge line to the single other one of the plurality of panels.

4. The dispenser of claim 1 further comprising a second access panel formed in one of the plurality of panels different from the front panel, the second access panel joining the first access panel when the body is formed.

5. A method comprising:

providing the dispenser of claim 2;

allowing eye shields to be dispensed therefrom reopening at least a portion of the front panel to expose the interior of the body along the height dimension thereof; and loading additional eye shields into the interior of the body; and closing the front panel to at least partially enclose the second stacked configuration of eye shields within the interior of the body.

6. The dispenser of claim 1 wherein the second outer side panel comprises the single other one of the plurality of panels for which the front panel is contiguous along the hinge line.

7. The dispenser of claim 1 wherein the first outer side panel comprises the single other one of the plurality of panels for which the front panel is contiguous along the hinge line.

8. The dispenser of claim 1 wherein the top panel comprises the single other one of the plurality of panels for which the front panel is contiguous along the hinge line.

9. The dispenser of claim 1 wherein the bottom panel comprises the single other one of the plurality of panels for which the front panel is contiguous along the hinge line.

10. The dispenser of claim 1 wherein the plurality of fold lines includes first, second, third, fourth, fifth, sixth, seventh, and eighth hinge lines, and wherein:

the top panel is contiguous with the first outer side panel along the first fold line, the bottom panel is contiguous with the first outer side panel along the second fold line, the first outside rear panel is contiguous with the first outer side panel along the third fold line, the first inner side panel is contiguous with the first outside rear panel along the fourth fold line, the inner rear panel is contiguous with the first inner side panel along the fifth fold line, the second inner side panel is contiguous with the inner rear panel along the sixth fold line, the second outside rear panel is contiguous with the second inner side panel along the seventh fold line, and the second outer side panel is contiguous with the second outside rear panel along the eighth fold line.

11. The dispenser of claim 1 wherein a combined width of the first outside rear panel, the second outside rear panel, and the inner rear panel is greater than a width of the front panel.

12. The dispenser of claim 1 wherein the attachment portions of the plurality of panels include a plurality of flaps and a plurality of slots, wherein each of the plurality of flaps are contiguous with one of the plurality of panels along a respective one of the plurality of fold lines, and wherein each of the plurality of slots are cutouts along a respective one of the plurality of fold lines and are configured to receive a respective one of the plurality of flaps.

13. The dispenser of claim 1 wherein the first access panel is disposed at least within the front panel of the plurality of interconnected panels by perforations, wherein the first access panel is configured to be removed to grant access to the interior of the body by tearing the perforations.

14. A method comprising: providing the dispenser of claim 2; and removing the first access panel to grant access to reveal the first one of the plurality of eye shields from within the interior of the body.

15. A method for loading a stacked configuration of eye shields into a dispenser, the method comprising:

providing a dispenser, the dispenser formed by folding a plurality of panels together along a plurality of fold lines and securing attachment portions of the plurality of panels to each other or one or more of the plurality of panels to form a body having a U-shaped cross-section, the plurality of panels being interconnected via the plurality of fold lines as defined in a contiguous blank;

loading a first stacked configuration of eye shields into an interior of the body through an opening exposed along a height dimension of the interior of the body; and closing a front panel of the plurality of panels along a hinge line to enclose the first stacked configuration of eye shields within the interior of the body, wherein the plurality of panels include a second outer side panel, a second inner side panel, a first outer side panel, a first inner side panel, an inner rear panel, a first outside rear panel, and a second outside rear panel, a top panel, and a bottom panel, and wherein the first inner side panel and second inner side panel each connect to the inner rear panel, the first inner side panel and second inner side panel obliquely disposed relative to one another and configured to extend in a converging manner away from the inner rear panel.

16. A blank for forming an eye shield dispenser, the blank comprising:

a contiguous sheet; and a plurality of fold lines formed in the contiguous sheet to define a plurality of panels, the plurality of panels configured to be folded along the plurality of fold lines to form a body of an eye shield dispenser having a U-shaped cross-section, and wherein the plurality of panels include a front panel that is contiguous with only a single other one of the plurality of panels along a hinge line of the plurality of fold lines, and wherein the front panel is configured, when assembled, to hingedly open via the hinge line to expose an interior of the body when the plurality of panels are folded along the plurality of fold lines to form the body, wherein the plurality of panels include a second outer side panel, a second inner side panel, a first outer side panel, a first inner side panel, an inner rear panel, a first outside rear panel, and a second outside rear panel, a top panel, and a bottom panel, and wherein the first inner side panel and second inner side panel each connect to the inner rear panel, the first inner side panel and second inner side panel obliquely disposed relative to one another and configured to extend in a converging manner away from the inner rear panel.

17. The blank of claim 16 wherein the plurality of fold lines further include first, second, third, fourth, fifth, sixth, seventh, and eighth fold lines.

18. The blank of claim 16 wherein the first outer side panel comprises the single other one of the plurality of panels for which the front panel is contiguous along the hinge line, wherein the plurality of fold lines further include first, second, third, fourth, fifth, sixth, seventh, and eighth fold lines, wherein the top panel is contiguous with the first outer side panel along the first fold line, wherein the bottom panel is contiguous with the first outer side panel along the second fold line, wherein the first outside rear panel is contiguous with the first outer side panel along the third fold line, wherein the first inner side panel is contiguous with the first outside rear panel along the fourth fold line, wherein the inner rear panel is contiguous with the first inner side panel along the fifth fold line, wherein the second inner side panel is contiguous with the inner rear panel along the sixth fold line, wherein the second outside rear panel is contiguous with the second inner side panel along the seventh fold line, and wherein the second outer side panel is contiguous with the second outside rear panel along the eighth fold line.

* * * * *